United States Patent [19]

Briggs et al.

[11] Patent Number: 4,955,359

[45] Date of Patent: Sep. 11, 1990

[54] FURNACE WITH COUNTERFLOW HEAT EXCHANGE MEANS

[75] Inventors: Eugene C. Briggs, Bowling Green, Ky.; Myron T. Cooperrider, North Royalton, Ohio

[73] Assignee: Robert Sun Company, Nashville, Tenn.

[21] Appl. No.: 391,101

[22] Filed: Aug. 8, 1989

[51] Int. Cl.[5] ..... F24H 3/00

[52] U.S. Cl. ..... 126/110 R; 126/110 B; 126/116 R

[58] Field of Search ..... 126/99 A, 110 R, 110 B, 126/110 D, 116 R

[56] References Cited

U.S. PATENT DOCUMENTS

| | | | |
|---|---|---|---|
| 2,210,736 | 8/1940 | Thoresen | 431/189 |
| 2,250,893 | 7/1941 | McCall | 126/110 |
| 2,263,098 | 11/1941 | Mueller | 126/116 R |
| 2,361,643 | 10/1944 | Mueller | 126/110 R |
| 2,613,663 | 10/1952 | Mitacek et al. | 126/110 |
| 2,758,590 | 8/1956 | Besser | 126/110 |
| 2,876,763 | 3/1959 | Hunter et al. | 126/110 |
| 3,189,017 | 6/1965 | Hahn | 126/116 R |
| 3,353,582 | 11/1967 | Vogt | 431/189 |
| 4,020,822 | 5/1977 | Harris | 126/110 R |
| 4,108,143 | 8/1978 | Pelsue et al. | 126/110 B |
| 4,794,908 | 1/1989 | Hall | 126/116 R |

FOREIGN PATENT DOCUMENTS

| | | | |
|---|---|---|---|
| 1278081 | 10/1961 | France | 126/110 R |
| 166145 | 2/1945 | Switzerland | 126/110 R |

*Primary Examiner*—Carroll B. Dority

*Attorney, Agent, or Firm*—Luedeka, Hodges & Neely

[57] ABSTRACT

A forced-air furnace for burning gas or fuel oil or waste oil utilizes relatively few components and effectively heats air for space-heating purposes. The furnace includes a substantially enclosed, elongated housing having an air intake and an air discharge vent and a hollow elongated heat exchanger/combustion chamber which is supported within so as to extend axially along the housing. The furnace also includes a fuel burner assembly supported at the discharge end of the housing for directing a flame and attending combustion products directly into the heat exchanger so that the inner surface thereof absorbs heat generated thereby and so that no part of the flame impinges upon the heat exchanger. Heat transfer from the combustion products to the heat exchanger is enhanced by a pair of removable platen-like baffles mounted within the heat exchanger. The combustion products are expelled from the heat exchanger through a flue discharge conduit having a section positioned within the heat exchanger, and a fan mounted within the housing routes air from the air intake and across the surfaces of both the heat exchanger flue conduit and the dual function heat exchanger/combustion chamber to the air discharge vent. A removable end cap attached to one end of the heat exchanger and a hinged burner assembly facilitate clean-out of the interior of the heat exchanger.

17 Claims, 5 Drawing Sheets

FURNACE WITH COUNTERFLOW HEAT EXCHANGE MEANS

BACKGROUND OF THE INVENTION

This invention relates generally to fuel oil, gas or waste oil-burning furnaces and relates, more particularly, to such furnaces of a forced-air type for heating air in climate control applications.

Forced-air furnaces employing oil or gas burners commonly include a ceramic combustion chamber within which combustion of the fuel takes place and a heat exchanger positioned about the combustion chamber for receiving heat generated within the chamber. The combustion chamber typically operates at high temperatures and for some furnaces is a frequent failure point. Combustion chambers are usually constructed of heavy materials so they are designed to a minimum size to hold down cost and weight, but operating temperatures are usually inversely proportional to chamber size. As the chamber becomes smaller, operating temperatures usually become greater. The combustion chamber is also exposed to the products of combustion which may include contaminants that will cause chamber failure. Thus, combustion chamber design is one of the more difficult design challenges in manufacturing a furnace.

SUMMARY OF THE INVENTION

This invention resides in a forced air furnace utilizing gas or oil as fuel. In accordance with the invention, a new integral combustion chamber/heat exchanger is provided to avoid the problems usually associated with these elements of a furnace. The combustion chamber of the present invention is preferably constructed of high temperature resistant sheet metal to provide light weight and low cost, and the chamber is an integral part of the heat exchanger. The burner is disposed in such a relationship to the chamber to avoid flame impingement on the chamber walls, and the chamber itself is designed to be sufficiently large to further avoid impingement by the burner flames. To achieve desired heat transfer between the burner and the chamber, at least one baffle is used to ensure adequate flow of combustion gases against the chamber interior, and the inner surface of the heat exchanger is exposed to radiant heat generated by the burner. With these features, the chamber and heat exchanger of the present invention overcome the weight, cost and failure problems of conventional chambers. Other features of the present invention enhance furnace efficiency, and removable end caps facilitate cleaning of the interior components of the furnace in the furnace.

In a particular embodiment of the present invention, the furnace includes a substantially enclosed housing, means for moving air through the housing and a heat exchanger supported within the housing so as to be exposed to the air flowing therethrough. The housing has opposite first and second ends, sidewalls extending between the first and second ends, an air intake associated with the first end and an air discharge vent associated with the second end. The means for moving air through the housing directs air from the first end of the housing to the second end thereof and generally axially therealong. The heat exchanger includes an elongated hollow body having two opposite ends and defines inner and outer surfaces. One of the hollow body ends provides an outlet end for the body, and the other hollow body end provides an inlet end for the body. Moreover, the heat exchanger is supported within so as to extend axially along the housing and so that air flowing from the air intake to the air discharge vent passes along the outer surface of the heat exchanger body from the outlet end to the inlet end.

The furnace further includes a hinged fuel burner assembly associated with the inlet end of the heat exchanger facilitating clean-out of the heat exchanger and for directing a flame and attending products directly into the heat exchanger body at the inlet end thereof so that the inner surface of the combustion heat exchanger absorbs heat generated by the flame and combustion products. The furnace also includes means for moving the combustion products of the burner assembly toward and through the outlet end of the heat exchanger body. A flue discharge conduit is supported within the housing adjacent the first end thereof and is operatively connected in flow communication with the heat exchanger body at the outlet end thereof so that combustion products moving through the outlet end of the heat exchanger body are routed by the flue discharge conduit out of the housing.

BRIEF DESCRIPTION OF THE DRAWINGS

FIG. 5 is a perspective view of a fragment of the FIG. 1 embodiment as seen from an alternative angle to that at which FIG. 1 is see and having portions shown cut-away.

DETAILED DESCRIPTION OF THE ILLUSTRATED EMBODIMENT

Figure 1:
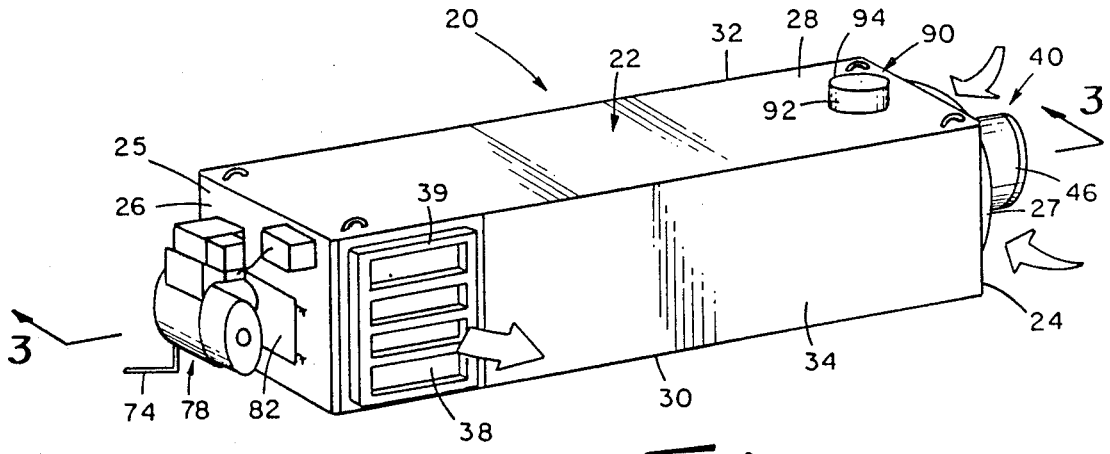
FIG. 1 is a perspective view of an embodiment of a furnace in accordance with the present invention.
Figure 2:
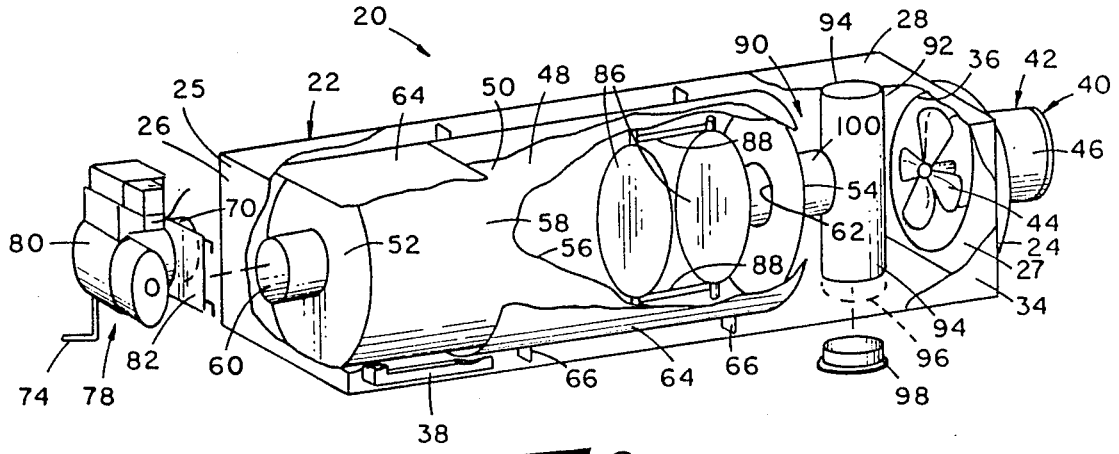
FIG. 2 is a view of the embodiment of FIG. 1 similar to that of FIG. 1 shown exploded and having portions shown cut-away.
Figure 3:
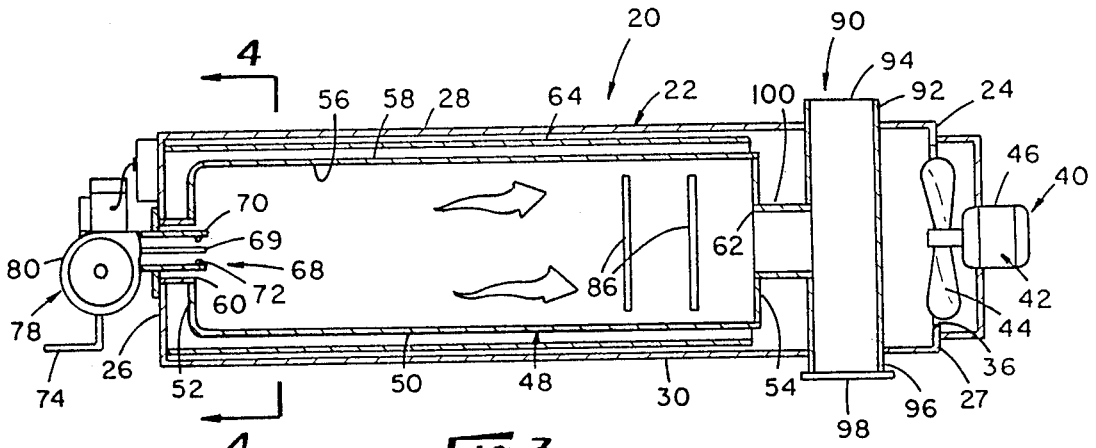
FIG. 3 is a cross-sectional view taken about on line 3—3 of FIG. 1.

Turning now to the drawings in greater detail and considering first FIGS. 1-3, there is shown an embodiment, generally indicated 20, of a furnace in accordance with the present invention shown operatively positioned in a room for heating the air space of the room. The furnace 20 is preferably supported from the room ceiling in a generally horizontal orientation of use and, as is explained herein, draws in room air at one of its ends and discharges air at the other of its ends at a higher temperature.

The furnace 20 includes elongated housing means 22 having two opposite ends 24, 26 and generally planar sidewalls extending between the ends 24, 26. Each of the ends 24 or 26 is covered by an end panel 25 or 27, respectively, and the planar sidewalls include opposite top and bottom panels 28, 30, respectively, and opposite side panels 32, 34. Each of the panels 28, 30, 32, 34 is maintained in such a positional relationship to one another that the housing means 22 is substantially square in cross-section. Furthermore, the panels 28, 30, 32, 34 are easily detachable from one another so as to provide relatively easy access to the interior of the housing means 22.

As best shown in FIGS. 1 and 3, an air intake 36 is provided for the housing means 22 by the end panel 25, and an air discharge vent 38 is provided in the side panel 34 adjacent the end 26. More specifically, the air intake 36 is defined by an opening provided in the end panel 25, and the air discharge vent 38 is defined by a louvered section 39 incorporated within the side panel 34.

With reference to FIGS. 2 and 3, the furnace includes means for moving, generally indicated 40, air from the air intake 36 to the air discharge vent 38. In the depicted embodiment 20, the moving means 40 includes a fan assembly 42 supportedly attached to the end panel 25 for directing air through the air intake 36, generally axially along the length of the housing means 22 and out of the air discharge vent 38. The fan assembly 42 includes propeller-type blades 44 and an electric motor 46 for rotating the blades 44.

In accordance with the present invention and with reference still to FIGS. 2 and 3, the furnace 20 includes a heat exchanger, generally indicated 48, having an elongated hollow body 50 operatively mounted within the housing means 22. The heat exchanger body 50 has an end 52 and an opposite, removable end 54 and defines substantially cylindrical inner and outer surfaces 56, 58, respectively. As best shown in FIG. 3, an inlet 60 is defined substantially centrally of the heat exchanger end 52, and an outlet 62 is defined substantially centrally of the heat exchanger end 54. The heat exchanger body 50 is supported within the housing means 22 by struts 66 so that the longitudinal axes of the housing means 22 and the heat exchanger body 50 are coincident with one another and so that air which is forced axially along the length of the housing means 22 by means of the fan assembly 42 is forced to pass along the cylindrical outer surface 58 of the heat exchanger body 50. Moreover, the heat exchanger body 5 is of such size in relation to the housing means 22 so that when the body 22 is operatively supported therein, the cylindrical outer surface 58 of the heat exchanger body 50 is spaced from the interior surfaces of the sidewalls of the housing means 22. Therefore, air which is moved axially along the housing means 22 by means of the fan assembly 42 is permitted to pass about the circumference of the body 50.

The furnace 20 further includes a heat shield 64 interposed between the heat exchanger body 50 and the sidewalls of the housing means 22 for preventing the sidewalls from becoming too hot to the touch and for reducing heat loss through the walls of the furnace 20. As best shown in FIG. 2, the heat shield 64 is substantially cylindrical in shape along a major portion of its length and opens adjacent the end 26 to accommodate air flow through the spacing defined between the heat exchanger body 50 and the heat shield 64 to the air discharge vent 38.

Figure 4:
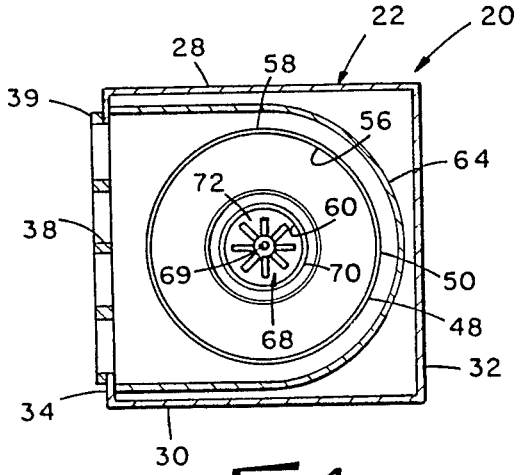
FIG. 4 is a cross-sectional view taken about on line 4—4 of FIG. 3.

In accordance with the present invention and with reference to FIGS. 3 and 4, the furnace 20 includes a fuel burner assembly 68 for discharging a flame and attending combustion products directly into the heat exchanger body 50. The fuel burner assembly 68 includes an outer casing 70 having an open end and a burner element 69 supported within the casing 70. The burner element is adapted to burn oil and is constructed in a manner which is known in the art. Oil is supplied to the burner element 69 through a conduit 74 operatively connected between a source of oil (not shown) and the burner assembly 68.

Figure 5:
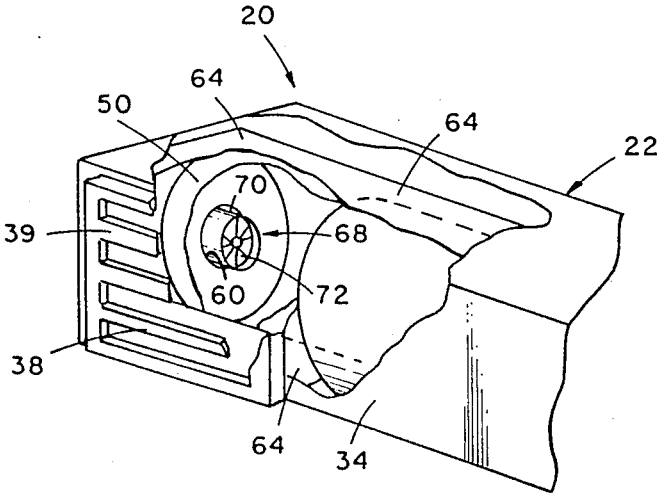

With reference to FIGS. 4 and 5, the outer casing 70 of the burner assembly 68 is positioned so as to extend axially through the inlet opening 60 of the heat exchanger 48 and so that the combustion products of the burner assembly 68 are discharged generally axially along the heat exchanger body 50. The furnace 20 also includes a flame retention head 72 supported within the heat exchanger body 50 and adjacent the end of the casing 70 for mixing the air and fuel at the element 69. The head 72 defines a central opening through which the flame and combustion products generated by the burner assembly 68 are directed and a plurality of vanes extending radially of the central opening. During operation of the furnace, the flame retention head 72 lowers the amount of air required for combustion to accommodate relatively small rates of air flow through the burner assembly 68.

As a consequence of the aforedescribed positional relationship between the burner assembly 68 and the heat exchanger body 50, only the products of combustion, and no part of the flames thereof, impinge directly upon the inner surface 56 of the heat exchanger body 50. Furthermore, all of the radiant energy generated by the flame of the assembly 68 is transmitted directly to the inner surface 56 of the body 50. By comparison, the heat exchangers of several conventional furnaces operate with heat received through conduction or through indirect heating.

For moving the combustion products of the burner assembly 68 toward the outlet of the heat exchanger body 50 and with reference again to FIGS. 1–3, a combustion blower assembly 78 is associated with the heat exchanger body 50. More specifically, the combustion blower assembly 78 includes an outer casing 80 defining a blower inlet and a blower outlet which is operatively connected to the burner casing 70 for directing air into the inlet 60 of the heat exchanger body 50. As best shown in FIG. 3, the casing 80 of the combustion blower assembly 78 is supportedly connected to the housing means 22 generally centrally of the end 26 in a manner described herein. In operation, room air is drawn into the inlet of the blower assembly 78 and routed through the heat exchanger inlet 60 and flame retention head 72 and toward the outlet 62 thereof.

Figure 6:
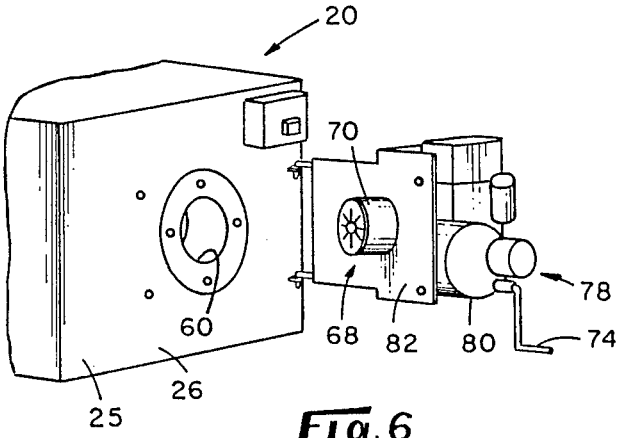
FIG. 6 is a fragmentary perspective view of the FIG. 1 embodiment shown with its burner and combustion blower assembly positioned in an out-of-the-way condition.

As best shown in FIGS. 3 and 6, the combustion blower assembly 78 and burner assembly 68 are operatively mounted upon a door panel 82 which is hingedly connected to the end panel 25 of the housing means 22. The door panel 82 is thereby movable between an operative, closed position at which the burner casing 70 projects through the inlet 60, as shown in FIG. 3, and an open position, as shown in FIG. 6, at which access is provided to the interior of the heat exchanger body 50 through the inlet 60 for clean-out purposes. The door panel 82 can be fixed in its closed position against the end panel 25 by means of screws. In addition, servicing of the burner assembly 68 is facilitated by movement of the door panel 82 to the open position, and the hinge arrangement connecting the door panel 82 to the housing means 22 permits the burner assembly 68 to be physically separated from the housing means 22 by lifting the door panel 82 and burner assembly 68 relative to the housing means 22 when the door panel is in its open position. With the door panel 82 separated from the housing means 22, the burner assembly 68 may be serviced remote of the housing means 22.

With reference again to FIG. 3, the furnace 20 includes a pair of baffles 86 mounted within the heat exchanger body 50 and adjacent the outlet 62 thereof. Each baffle 86 is in the form of a circular platen having a diameter which is smaller than that of the inner surface 56 of the heat exchanger and which is operatively mounted within the interior of the heat exchanger body 50 by means of spacers 88. The spacers 88 support the baffles 86 in a parallel relationship and so that each baffle 86 is oriented in a radial plane of the heat exchanger body 50 and spaced from the inner surface 56 thereof. Moreover, the baffles 86 are joined together in a single assembly.

During operation of the furnace 20 and as the combustion products from the burner assembly 68 move toward the heat exchanger outlet 62, the baffles 86 block movement of the combustion products through the central regions of the heat exchanger body 50. Therefore, the combustion products are compelled by the baffles 68 to flow along in close proximity to the inner surface 56 as the combustion products flow around the baffles 68 so that the combustion products "scrub" the surface 56. The flowing of the combustion products along the inner surface 56 as aforedescribed enhances the extraction of heat from the combustion products by the heat exchanger body 50, and the baffles 86 are believed to be advantageous in this respect.

In accordance with one aspect of the present invention and with reference again to FIGS. 2 and 3, the furnace 20 includes a T-shaped flue discharge conduit 90 supported within the housing means 22 adjacent the end 24 thereof for routing combustion products from the outlet 62 of the heat exchanger body 50 and through a sidewall of the housing means 22. The discharge conduit 90 includes a first section 92 which is generally cylindrical in shape and supported within the housing means 22 so that its longitudinal axis is generally perpendicular to the longitudinal axis of the heat exchanger body 50. The first section 92 has one end, indicated 94, which extends through the top panel 28 of the housing means 22 for routing combustion products therethrough and another end, indicated 96, which extends through the bottom panel 30. In the depicted embodiment 20, end 96 is covered by means of a drip cap 98 (FIG. 2) facilitating clean-out of the conduit 90 and for collecting water which may accumulate in the conduit 90.

The flue discharge conduit 90 includes a second section 100 joined to the first section 92 at generally right angles thereto and is connected to the heat exchanger end 54 about the outlet 62 thereof. The second section 100 is substantially cylindrical in shape and oriented so that its longitudinal axis coincides with that of the heat exchanger body 50. It follows that the flue discharge conduit 90 is in flow communication with the outlet 60 of the heat exchanger 48 so that combustion products exiting the heat exchanger body 50 are routed out of the furnace 20 through the top panel 28.

During operation of the furnace 20, combustion products move from the burner assembly 68 and out of the furnace top panel 28 in the manner described above so that heat is extracted from the combustion products by both the heat exchanger body 50 and the flue discharge conduit 90. Therefore, when air moved by the fan 42 from the air intake 36 to the air discharge vent 38, the air extracts heat from the surfaces of both the heat exchanger body 50 and the flue discharge conduit 90. Because the first section 92 of the flue discharge conduit 90 is oriented generally perpendicular to the direction of the air moving into the housing means 22 through the air intake 38 thereof, the transfer of heat from the first section 92 to the air is enhanced. Thus, the flue discharge conduit 90 provides the furnace 20 with a secondary heat exchanger in addition to the heat exchanger body 50.

From the foregoing it will be appreciated that the heat exchanger body 50 functions as both a heat exchanger and a combustion chamber. Hence, the furnace can be comprised of relatively few components which contribute to a reduction in unit cost and weight. Because of its relative lightness in weight, the furnace 20 may be suspended from a ceiling with little or no need for ceiling reinforcement.

An advantage provided by the furnace 20 relates to the disposition of the burner assembly 68 and fan assembly 42 relative to the discharge and inlet ends of the furnace 20. More specifically, the burner assembly 68 is supported in the discharge end of the furnace 20 so that combustion products emitted from the burner assembly 68 are directed counter to the flow of air along the outside surface of the heat exchanger body 50. With the fan assembly 42 blowing cool inlet air directly upon the discharge conduit 90 at the inlet end of the furnace 20, the conduit 90 is maintained in relatively cool condition during furnace operation. Moreover, because unit efficiency is commonly a function of the stack or conduit temperature at the outlet end of the furnace 90 and the stack temperature is maintained in a relatively cool condition by the fan assembly 42, the unit efficiency is believed to be enhanced by the positioning of the fan assembly 42 adjacent the conduit 90.

Still another advantage provided by the furnace 20 relates to its relatively long useful life. In this connection, each of the heat exchanger body and flue discharge conduit 90 which are heated internally by the products of combustion are maintained in a relatively cool condition by the air moving through the housing means 22, and it is this relatively cool operation of the furnace components that contributes to the life of the furnace 20.

Furthermore, because there is no direct flame impingement from the burner assembly 68 upon any other component, such as the heat exchanger body 50, of the furnace, the furnace components do not experience damage resulting from such flame impingement.

Yet another advantage of the furnace 20 relates to the accessibility of the interior of the heat exchanger for cleaning purposes. For example, access into the outlet end of the heat exchanger body 50 is provided by removing the fan assembly 42, flue conduit 90 and body end 54 from the remainder of the furnace 20. If desired, and as mentioned earlier, the baffles 86 can be removed from the heat exchanger body 50 as a single assembly for cleaning purposes. Similarly, access into the inlet end of the heat exchanger body 50 can be provided by moving the burner assembly 68 to the FIG. 6 out-of-the way condition.

Figure 7:
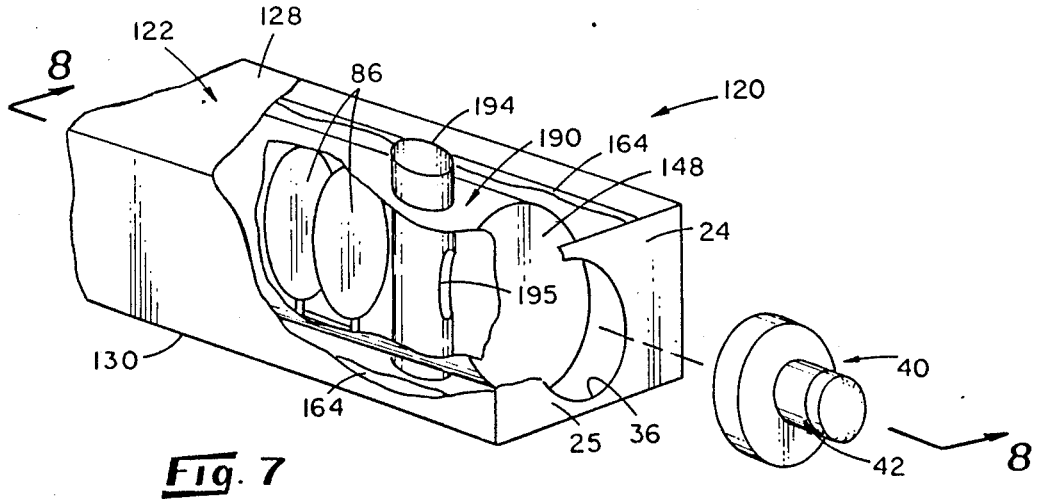
FIG. 7 is a fragmentary perspective view of another embodiment of a furnace in accordance with the present invention.
Figure 8:
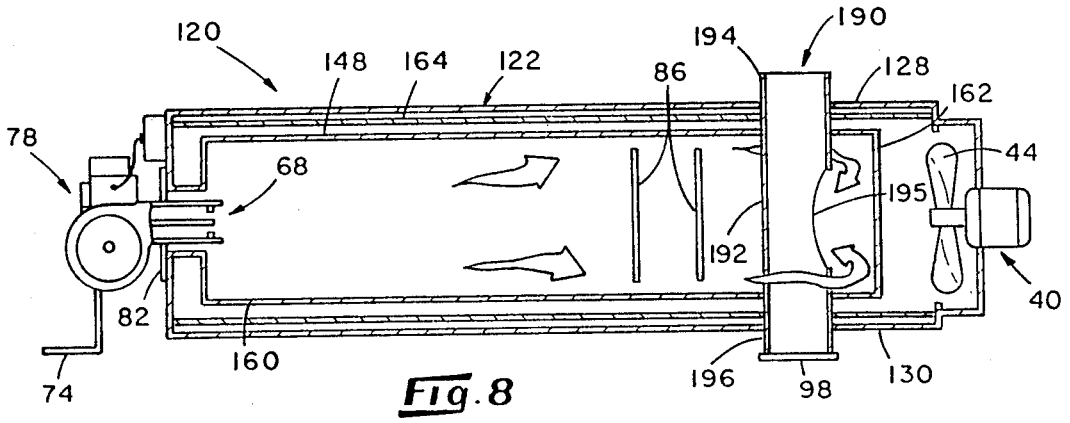
FIG. 8 is cross-sectional view taken about on line 8—8 of FIG. 7.

With reference to FIGS. 7 and 8, there is shown an alternative embodiment, indicated 120, of a furnace in accordance with the present invention. The furnace 120 includes several components, such as a fan assembly 42 and a combustion blower assembly 78, which correspond to components of the furnace 20 of FIGS. 1–6, and accordingly these components bear the same reference numerals. The furnace 120 also includes housing means 122 having a top panel 128 and a bottom panel 130 and a heat exchanger 148 extending between opposite ends of the housing means 122. A heat shield 164 is positioned between the heat exchanger 148 and the sidewalls of the housing means 122.

In accordance with the present invention, the furnace 120 further includes a flue discharge conduit 190 having a section 192 positioned within the body of the heat exchanger 148 adjacent the outlet end 162 thereof. As best shown in FIG. 8, the section 192 is oriented transverse to the longitudinal axes of the heat exchanger 148 and housing means 122 and has two opposite ends 194 and 196 which each extend through the body of the heat exchanger 148, the heat shield 164, and a corresponding one of the top and bottom panels 128, 130. One end 196 of the conduit 190, or the lower end as shown in FIG. 8, is capped with a drip cap 98, and the other, or upper end 194, is open so that combustion products which enter the conduit 190 are discharged through the top panel 128.

In order that the combustion products which are emitted from the burner assembly 68 enter flue conduit 190, an opening 195 is defined in the conduit section 102 so as to open in a direction opposite the heat exchanger inlet end, indicated 160. Therefore, as combustion products are emitted from the burner assembly 68, they pass the baffles 86 and move around the circumferential periphery of the conduit section 192 in order to enter the opening 195. It is believed that the positioning of the conduit section 192 within the heat exchanger body accommodates a shortening of the overall length of the furnace 120. Furthermore, the disposition of the section opening 195 relative to the heat exchanger inlet end 160 forces the combustion products to move in close proximity to the inner surfaces of the heat exchanger at the outlet end 162 before entering the conduit 190 to enhance the exchange of heat from the combustion products to the heat exchanger 148.

Figure 9:
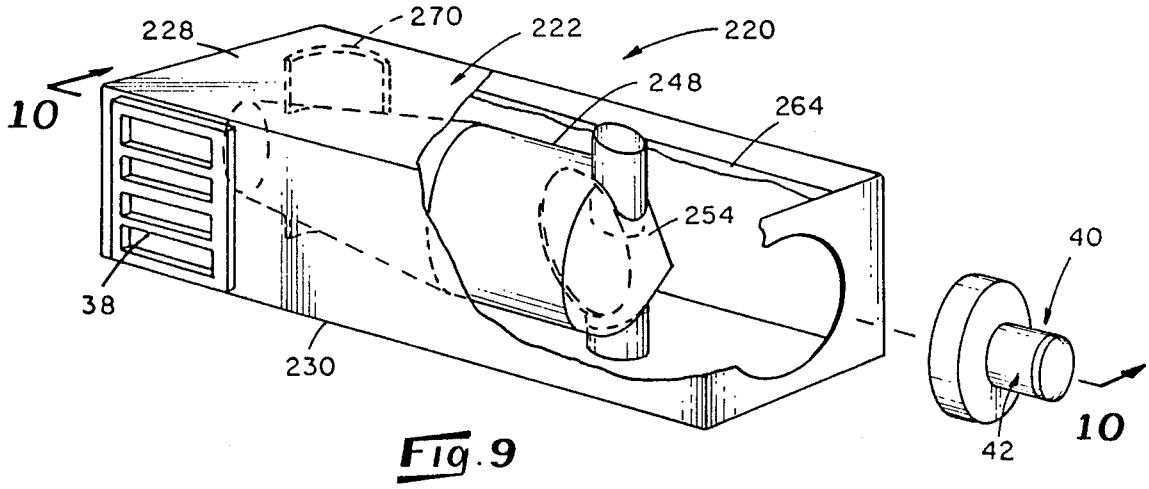
FIG. 9 is a view similar to that of FIG. 7 of still another embodiment of a furnace in accordance with the present invention.
Figure 10:
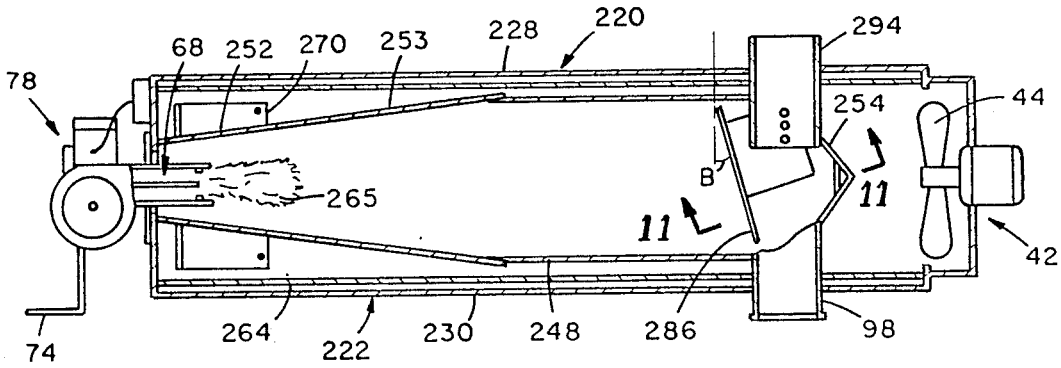
FIG. 10 is a cross-sectional view taken about on line 10—10 of FIG. 9.

With reference to FIGS. 9 and 10, there is shown still another embodiment, indicated 220, of a furnace in accordance with the present invention. The furnace 220 includes several components, such as a fan assembly 42 and a combustion blower assembly 78, which correspond to components of the furnace 20 of FIGS. 1–6, and accordingly these components bear the same reference numerals. The furnace 220 also includes housing means 222 having a top panel 228 and a bottom panel 230 and a heat exchanger 248 extending between opposite ends of the housing means 222. A heat shield 264 is positioned between the heat exchanger 248 and the sidewalls of the housing means 222.

It is feature of the furnace 220 that the end 254 of the heat exchanger 248 situated closest to the fan assembly 42 is substantially conical in shape so that its smaller section is directed generally toward the fan assembly 42. Such a conical shape may be preferred, in some instances, over the flat-ended heat exchanger 148 of the furnace 120 of FIGS. 7 and 8 due to the reduction in fan power required to move the intake air along the outer surface of the heat exchanger 248 over that required to move air along the heat exchanger 148. Thus, the conical end of the heat exchanger 248 adjacent the fan assembly 42 effectively streamlines the corresponding heat exchanger end so as to enhance the air flow performance thereacross.

It is another feature of the furnace 220 that the end 252 of the heat exchanger 248 situated closest to the combustion blower assembly 78 is tapered so that its diameter increases as a path is traced axially through the heat exchanger 248 from the blower assembly 78. Such a tapering of the corresponding heat exchanger end reduces the static pressure at the air-discharge end of the housing means 222 by providing a larger cross section for air moving between the heat exchanger 248 and the housing means 222 toward the discharge vent. Furthermore and as best shown in FIG. 10, the slope of the aforedescribed taper, or tapered section 253, corresponds generally with the slope of the sides of the flame 265 emitted from the burner assembly 68. Such a correspondence is responsible for an efficient utilization of the radiant heat energy generated by the flame 265 and higher skin temperatures of heat exchanger 248. Still further, the bottom wall of the tapered section gravitationally directs ash which may result from the combustion reaction toward the middle, or cylindrical mid-section 255, of the heat exchanger 248 where the ash may be removed through the drip cap 98. Yet still further and as illustrated in FIG. 10, the right end of the tapered section 253 of the heat exchanger 248 overlaps the cylindrical mid-section 255 thereof and facilitates the attachment, such as by welding, of the tapered section 253 to the mid-section 255.

For purposes of routing air around the tapered section of the heat exchanger 248 and toward the discharge vent 38, there is provided an air baffle 270 mounted adjacent the heat exchanger opposite the vent 38. The air baffle 270 is in the form of a curved plate disposed adjacent the heat exchanger end 252 so that air which is directed axially across the outer surface of the heat exchanger 248 is deflected by the curvature of the baffle 270 toward the vent 38. Such a deflection of the air is advantageous in that it helps to straighten out the air flow exiting the vent 38 and enhances the air flow across the end 252 of the heat exchanger 248 which normally has the highest temperatures during furnace operations.

The furnace 220 also includes baffle means in the form of a single circular baffle plate 286 mounted within the heat exchanger 248 adjacent the fan assembly end 254 thereof. The baffle plate 286 is supported within the heat exchanger 248 at an angle B (FIG. 10) of about fifteen degrees with a radial plane of the heat exchanger 248. By angling the baffle plate 286 in the manner illustrated in FIG. 10, both sides of the plate 286 are easily accessible through the drip cap 98 for cleaning purposes, with no need to remove the fan assembly 42 and heat exchanger end 254. In addition, because the edges of the plate 286 force combustion products emitted from the burner to travel closely along the inside wall of the heat exchanger 286, heat from the combustion products is effectively transferred to the walls of the heat exchanger 248.

Figure 11:
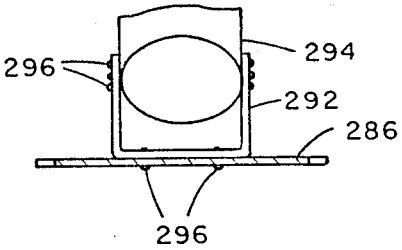
FIG. 11 is a cross-sectional view taken about on line 11—11 of FIG. 10.

Preferably, the baffle plate 286 is constructed of a high temperature stainless steel so that it is not likely to require replacement. In addition and as illustrated in FIG. 11, the plate 286 is supported within the heat exchanger 248 by means of a bracket 292 interposed between the plate 286 and the discharge conduit 294. The bracket 292 is U-shaped in cross section and arranged so that the legs of its U are positioned on opposite sides of the discharge conduit 294 and the base of its U flatly engages one side of the baffle plate 286. The bracket 292 is suitably fixed to the plate 286 and the discharge conduit 294 with rivets 296.

It will be understood from the foregoing that numerous modifications and substitutions can be had to the aforedescribed embodiments 20, 120, 220 without departing from the spirit of the invention. For example, although the air-moving means for moving air through the furnace 20,120 has been shown and described above as including a propeller-type fan assembly 42, the air-moving means may instead include a centrifugal blower. Accordingly, the aforedescribed embodiment 20 is intended for the purpose of illustration and not as limitation.

What is claimed is:

1. A furnace comprising:

substantially enclosed housing means having opposite first and second ends, sidewalls extending between said first and second ends, an air intake associated with said first end, and an air discharge vent associated with said second end;

means for moving air from said air intake to said air discharge vent so that air moved by said air-moving means moves air from said first end to said second end and generally axially along said housing means;

a heat exchanger including an elongated hollow body having two opposite ends and defining inner and outer surfaces, one of said hollow body ends providing an outlet end for said body and the other of said hollow body ends providing an inlet end for said body, said heat exchanger being supported within so as to extend axially along said housing means and so that air flowing from said air intake to said air discharge vent passes along the outer surface of the heat exchanger body from said one body end to the other body end;

a fuel burner assembly associated with said inlet end of said heat exchanger for directing a flame and attending combustion products directly into the heat exchanger body at said inlet end so that the inner surface of the heat exchanger absorbs heat generated by the flame and combustion products and so that the flame is directed by the fuel burner assembly generally axially of the heat exchanger toward the outlet end thereof;

means associated with the heat exchanger for delivering air to the burner assembly for combustion purposes and so that combustion products discharged from said burner assembly move toward and through the outlet end of the heat exchanger; and a flue discharge conduit supported within said housing means adjacent said first end thereof and operatively connected in flow communication with said heat exchanger body at the outlet end thereof so that combustion products moving through the outlet end of said heat exchanger body are routed by said flue discharge conduit out of said housing means; and said inlet end of said heat exchanger body is tapered in shape so that the transverse cross-sectional area of said heat exchanger body increases in size as a path is traced axially through said heat exchanger body toward said outlet end thereof.

2. A furnace comprising:

substantially enclosed housing means having opposite first and second ends, sidewalls extending between said first and second ends, an air intake associated with said first end, and an air discharge vent associated with said second end;

means for moving air from said air intake to said air discharge vent so that air moved by said air-moving means moves air from said first end to said second end and generally axially along said housing means;

a heat exchanger including an elongated hollow body having two opposite ends and defining inner and outer surfaces, one of said hollow body ends providing an outlet end for said body and the other of said hollow body ends providing an inlet end for said body, said heat exchanger being supported within so as to extend axially along said housing means and so that air flowing from said air intake to said air discharge vent passes along the outer surface of the heat exchanger body from said one body end to the other body end;

a fuel burner assembly associated with said inlet end of said heat exchanger for directing a flame and attending combustion products directly into the heat exchanger body at said inlet end so that the inner surface of the heat exchanger absorbs heat generated by the flame and combustion products;

means associated with the heat exchanger for delivering air to the burner assembly for combustion purposes and so that combustion products discharged from said burner assembly move toward and through the outlet end of the heat exchanger;

a flue discharge conduit supported within said housing means adjacent said first end thereof and operatively connected in flow communication with said heat exchanger body at the outlet end thereof so that combustion products moving through the outlet end of said heat exchanger body are routed by said flue discharge conduit out of said housing means; and means defining a flame retention head positioned generally about the flame and cooperating with the means for moving the combustion products to enhance the mixture of air with fuel at the site of burner combustion.

3. The furnace of claim 2 wherein the flue discharge conduit includes a section oriented substantially transverse to the air moving axially through said housing means from said air intake to said air discharge vent for transferring heat from said transverse section to the axially-moving air.

4. The furnace of claim 2 wherein the flue discharge conduit includes a section positioned generally between the outlet end of said heat exchanger body and the air intake of the housing means so as to be exposed to air moving axially through said housing means from said air intake to said air discharge vent.

5. A furnace comprising:

substantially enclosed housing means having opposite first and second ends, sidewalls extending between said first and second ends, an air intake associated with said first end, and an air discharge vent associated with said second end;

means for moving air from said air intake to said air discharge vent so that air moved by said air-moving means moves air from said first end to said second end and generally axially along said housing means;

a heat exchanger including an elongated hollow body having two opposite ends and defining inner and outer surfaces, one of said hollow body ends providing an outlet end for said body and the other of said hollow body ends providing an inlet end for said body, said heat exchanger being supported within so as to extend axially along said housing means and so that air flowing from said air intake to said air discharge vent passes along the outer surface of the heat exchanger body from said one body end to the other body end;

a fuel burner assembly associated with said inlet end of said heat exchanger for directing a flame and attending combustion products directly into the heat exchanger body at said inlet end so that the inner surface of the heat exchanger absorbs heat generated by the flame and combustion products;

means associated with the heat exchanger for delivering air to the burner assembly for combustion purposes and so that combustion products discharged from said burner assembly move toward and through the outlet end of the heat exchanger; and a flue discharge conduit supported within said housing means adjacent said first end thereof and operatively connected in flow communication with said heat exchanger body at the outlet end thereof so that combustion products moving through the outlet end of said heat exchanger body are routed by said flue discharge conduit out of said housing means;

the outlet end of said heat exchanger defines a substantially centrally-positioned opening which is smaller in cross-sectional area than the area of a transverse cross section taken through said heat exchanger body at the outlet end thereof, and the outlet of said heat exchanger is provided by said centrally-positioned opening and said flue discharge conduit is connected to said heat exchanger body so as to receive combustion products from said heat exchanger through said centrally-positioned opening.

6. The furnace of claim 2 wherein the flue discharge conduit includes one section positioned within said heat exchanger body and oriented substantially transverse to the longitudinal axis of said heat exchanger body, and said one section defines an opening therein for receiving the combustion products directed through said heat exchanger body.

7. A furnace comprising:

substantially enclosed housing means having opposite first and second ends, sidewalls extending between said first and second ends, an air intake associated with said first end, and an air discharge vent associated with said second end;

means for moving air from said air intake to said air discharge vent so that air moved by said air-moving means moves air from said first end to said second end and generally axially along said housing means;

a heat exchanger including an elongated hollow body having two opposite ends and defining inner and outer surfaces, one of said hollow body ends providing an outlet end for said body and the other of said hollow body ends providing an inlet end for said body, said heat exchanger being supported within so as to extend axially along said housing means and so that air flowing from said air intake to said air discharge vent passes along the outer surface of the heat exchanger body from said one body end to the other body end;

a fuel burner assembly associated with said inlet end of said heat exchanger for directing a flame and attending combustion products directly into the heat exchanger body at said inlet end so that the inner surface of the heat exchanger absorbs heat generated by the flame and combustion products;

means associated with the heat exchanger for delivering air to the burner assembly for combustion purposes and so that combustion products discharged from said burner assembly move toward and through the outlet end of the heat exchanger; and a flue discharge conduit supported within said housing means adjacent said first end thereof and operatively connected in flow communication with said heat exchanger body at the outlet end thereof so that combustion products moving through the outlet end of said heat exchanger body are routed by said flue discharge conduit out of said housing means;

the flue discharge conduit includes one section positioned within said heat exchanger body and oriented substantially transverse to the longitudinal axis of said heat exchanger body, and said one section defines an opening therein for receiving the combustion products directed through said heat exchanger body; and said opening of said one section opens generally away from said fuel burner assembly so that combustion products emitted from said burner assembly and which enter said opening of said one section travel around the circumferential periphery of said one section.

8. The furnace of claim 2 further comprising baffle means positioned within said heat exchanger body and adjacent the outlet end thereof for routing the combustion products along the inner surface of the heat exchanger body.

9. The furnace of claim 8 wherein said baffle means includes at least one platen positioned within said heat exchanger body and arranged so that the edges of each platen are spaced from the inner surface of said heat exchanger body.

10. The furnace of claim 9 wherein said housing means includes a removable section attached to the remainder of said housing means adjacent the first end thereof so that when said removable section is removed from the remainder of said housing means, access is provided to said outlet end of said heat exchanger body, said outlet end of said heat exchanger body defines an opening therein through which flow communication between said heat exchanger body and said flue discharge conduit is effected and providing access to at least one of said platens so that at least one platen is accessible through said removable section of said housing means to facilitate cleaning of at least one platen.

11. The furnace of claim 10 wherein the one platen of said baffle means is arranged within said heat exchanger body so as to be disposed in an angular relationship with a plane oriented generally perpendicular to the longitudinal axis of said heat exchanger body to facilitate cleaning of the opposite sides of said platen upon removal of the removable section of said housing means and so that the edges of the platen are spaced from the inner surface of said heat exchanger so that combustion products are routed between the inner surface of said heat exchanger and the platen edges in a predetermined pattern of flow.

12. The furnace of claim 2 wherein said discharge vent is defined in a sidewall of said housing means adjacent said second end.

13. The furnace of claim 2 wherein said means for moving air from said air inlet to said air outlet includes air-moving means attached to the first end of said housing means so that air directed into said air intake by said air-moving means is directed generally axially of said housing means.

14. A furnace comprising:

substantially enclosed housing means having opposite first and second ends, sidewalls extending between said first and second ends, an air intake associated with said first end, and an air discharge vent associated with said second end;

means for moving air from said air intake to said air discharge vent so that air moved by said air-moving means moves air from said first end to said second end and generally axially along said housing means;

a heat exchanger including an elongated hollow body having two opposite ends and defining inner and outer surfaces, one of said hollow body ends providing an outlet end for said body and the other of said hollow body ends providing an inlet end for said body, said heat exchanger being supported within so as to extend axially along said housing means and so that air flowing from said air intake to said air discharge vent passes along the outer surface of the exchanger body from said one body end to the other body end;

a fuel burner assembly associated with said inlet end of said heat exchanger for directing a flame and attending combustion products directly into the heat exchanger body at said inlet end so that the inner surface of the heat exchanger absorbs heat generated by the flame and combustion products;

means associated with the heat exchanger for delivering air to the burner assembly for combustion purposes and so that combustion products discharged from said burner assembly move toward and through the outlet end of the heat exchanger; and a flue discharge conduit supported within said housing means adjacent said first end thereof and operatively connected in flow communication with said heat exchanger body at the outlet end thereof so that combustion products moving through the outlet end of said heat exchanger body are routed by said flue discharge conduit out of said housing means;

said means for moving air from said air inlet to said air outlet includes air-moving means attached to the first end of said housing means so that air directed into said air intake by said air-moving means is directed generally axially of said housing means; and said outlet end of said heat exchanger body is shaped so as to have opposite small and large sections and is arranged so that the smaller section thereof is directed generally toward said air-moving means so that air directed axially of said housing means moves from the small section to the large section of the heat exchanger outlet end.

15. The furnace of claim 2 wherein said heat exchanger inlet end defines a centrally-positioned opening therein and said fuel burner assembly directs a flame and attending combustion products through said centrally-positioned opening and toward the outlet end of said heat exchanger body.

16. The furnace of claim 15 wherein the fuel burner assembly is hingedly connected to the second end of said housing means for movement between an operative position adjacent said second end at which the flame and combustion products are directed through said centrally-positioned opening as aforesaid and an out-of-the-way position providing access to the interior of said heat exchanger body through said centrally-positioned opening for easy clean-out of combustion ash.

17. The furnace of claim 11 wherein said one platen is disposed at about a fifteen degree angle with a plane oriented generally perpendicular to the longitudinal axis of the heat exchanger body so that the bottom of the platen is positioned farther from the burner assembly than is the top of the platen.

* * * * *